United States Patent [19]

Cardine

[11] Patent Number: 5,020,841

[45] Date of Patent: Jun. 4, 1991

[54] MECHANISM FOR LINKING AN OPENING HANDLE TO A PUSH PIN FOR THE LOCK OF A VEHICLE DOOR

[75] Inventor: Patrice Cardine, Orleans, France

[73] Assignee: Rockwell Automotive Body Systems-France, France

[21] Appl. No.: 597,250

[22] Filed: Oct. 15, 1990

[30] Foreign Application Priority Data

Oct. 17, 1989 [FR] France ..... 89 13558

[51] Int. Cl.[5] ..... E05C 21/00

[52] U.S. Cl. ..... 292/336.3; 292/347; 292/DIG. 60

[58] Field of Search ..... 292/336.3, 347, 221, 292/DIG. 53, DIG. 60, 1

[56] References Cited

U.S. PATENT DOCUMENTS 2,188,532 1/1940 Dominguez ..... 292/347 X
2,834,628 5/1958 Paparelli et al. ..... 292/347
4,283,155 8/1981 Yamazaki et al. ..... 292/336.3 X
4,415,192 11/1983 Kadama et al. ..... 292/347
4,486,041 12/1984 Takasaki ..... 292/221

*Primary Examiner*—Richard E. Moore

[57] ABSTRACT

This mechanism (3) for linking an opening handle (4) to a lock pin (2) comprises a calliper (6) interacting with the handle (4), a rod (11) engaged so as to slide in only one direction in a sleeve (13) at the lower end of which the pin (2) is inserted; the sleeve (13) is equipped with a ring (19) which is slidably fitted around the sleeve and can be moved during set-up from a first position at the base of the flexible arms (14) to a second position situated at the ends of the arms nearest the calliper (6), in which position the ring (19) clamps the arms (14) around the rack (12) and is held in place by suitable means (23, 24). The ring (19) prevents the arms (14) and their inner teeth from coming away at all from the rack (12), thereby guaranteeing the total irreversibility of the mechanism in both directions of the link.

4 Claims, 2 Drawing Sheets

Fig-3
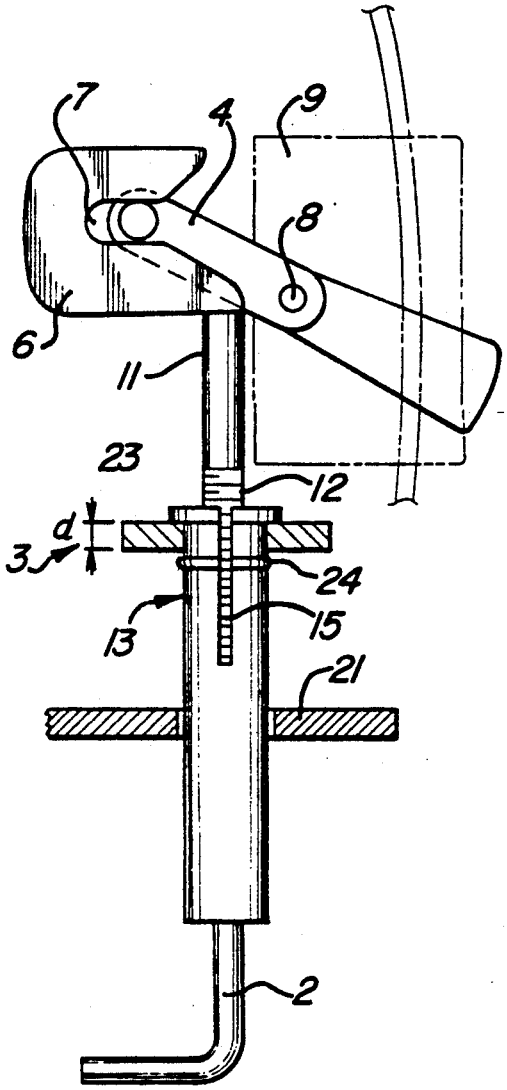
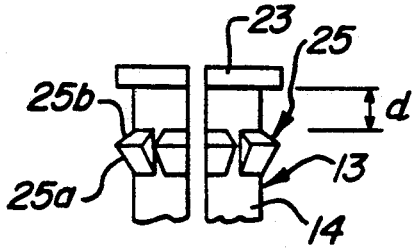
Fig-4

MECHANISM FOR LINKING AN OPENING HANDLE TO A PUSH PIN FOR THE LOCK OF A VEHICLE DOOR

The present invention relates to a mechanism for linking an opening handle to a push pin for the lock of a vehicle door.

A mechanism is known which comprises a calliper designed to receive the handle, and a rod which connects this calliper with the pin, engaged so as to slide in only one direction in a sleeve by virtue of a non-return system, in such a way that after the handle and calliper have been assembled, a swinging down of the handle causes a relative movement of the rod and of the sleeve, setting their respective positions without play. The rod is provided with a rack which penetrates axially into the sleeve between the flexible longitudinal clamping arms, which are able to interact with the rack to set the axial position of the rod in the sleeve.

This mechanism is satisfactory, but does not however guarantee the total irreversibility of the mechanism in both directions of the link. There is in fact a risk that the elastic arms of the sleeve may slip over the rack, if some external element (ice, a seize-up) stops the pin from coming back up.

It is therefore an object of the invention to produce a mechanism which prevents any relaxing of the flexible arms and consequently any weakening of their grip on the rack.

According to the invention, the sleeve is equipped with a ring which is slidably fitted around the sleeve and can be moved during set-up from a first position at the base of the flexible arms to a second position situated at the ends of the said arms nearest the calliper, in which position the ring clamps the arms around the rack, and these arms are provided at the said ends with means for retaining the ring in the said second position.

The clamping of the arms by the ring, and its being axially locked on the end of the sleeve, prevent the flexible arms from coming away at all from the rack, even if the pin fails to come back up owing to a seize-up, ice and the like. This means that total irreversibility of the mechanism in both directions of the link is guaranteed.

Other features and advantages of the invention will appear in the course of the following description, given with reference to the attached drawings which illustrate one embodiment of it by way of a non-limiting example.

FIG. 3 is a similar view to FIGS. 1 and 2 showing the sleeve and rod in the raised position and the ring held in its locking position at the upper end of the sleeve.

FIG. 4 is a partial elevation view of an alternative embodiment of the sleeve.

Figure 1:
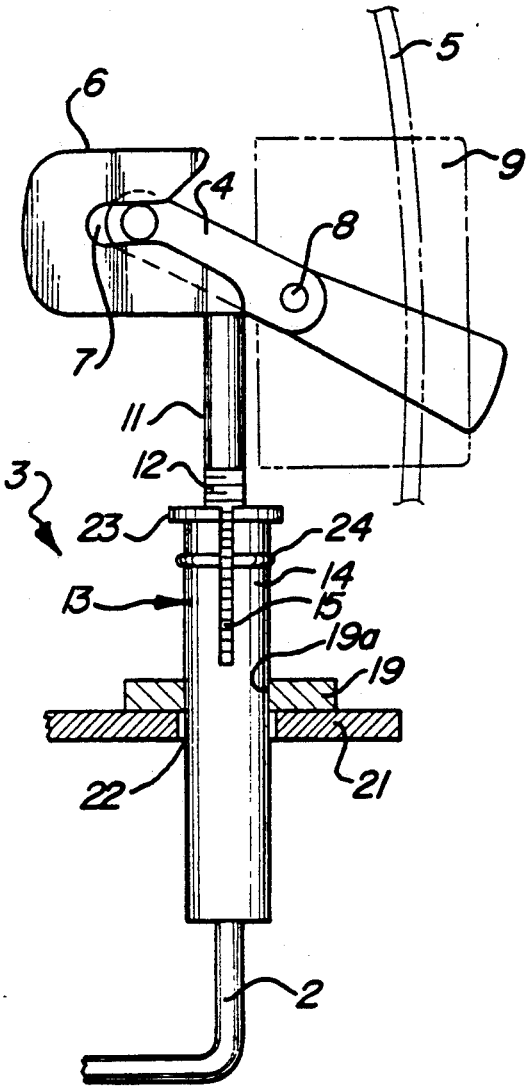
FIG. 1 is an elevation view, with partial cross-section, of an embodiment of the link mechanism according to the invention with its sleeve-locking ring in the down position on the sleeve, while the sleeve in contrast is in the up position.

The mechanism 3 shown in the drawings comprises a calliper 6 made in the form of a hook defining an opening 7 which receives a handle 4 from the outer shell 5 of the door of the vehicle.

The mechanism 3 is connected by a pin 2 to a lock (not shown) and the opening handle 4 is mounted so as to swing about an axis 8 in a housing 9 which is integral with the outer shell 5. A rod 11 fitted axially into a tubular sleeve 13 provides the link between the calliper 6 and the lock pin 2 whose upper end is inserted into the lower end of the sleeve 13. The rod 11 is provided with a rack 12 consisting of a toothing formed around the rod except on that end of it which is fixed to the calliper 6. The rack 12 penetrates axially into the sleeve 13 between flexible longitudinal clamping arms 14, these arms being provided internally with teeth which are complementary to those of the toothing 12, and designed so as to allow the rack 12 and rod 11 to move in only one direction inside the sleeve 13, namely the direction of extraction of the rod 11 from the sleeve, when the arms 14 are in engagement with the rack 12.

The flexible arms 14 are separated by longitudinal slots 15 and can therefore be moved out of the way to allow the rod 11 to be inserted between the arms 14 to the desired depth. The arms 14, being then freed, fall back elastically onto the rack 12 and keep it in the corresponding axial position.

The sleeve 13 is equipped with a ring 19 which is slidably fitted around the sleeve and can be moved during the setting of the position of the rod 11 in the sleeve 13 from a first position substantially at the base of the flexible arms 14 (FIG. 1) to a second position situated at the ends of the said arms 14 nearest the calliper 6 (FIGS. 2 and 3), in which position the ring 19 clamps the arms around the rack 12.

For this purpose the device comprises a plate 21 fixed relative to the mechanism 3 and pierced by a hole 22 through which the sleeve 13 passes.

Figure 2:
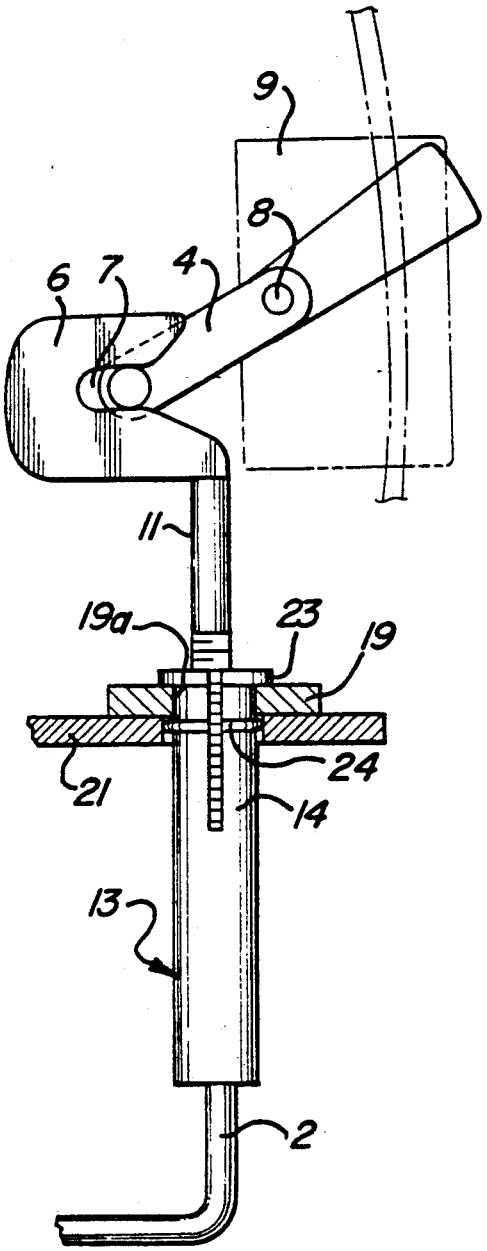
FIG. 2 is a similar view to FIG. 1 showing the sleeve and rod in the down position by the swinging of the corresponding handle of the door, the ring being in its locking position at the end of the sleeve after sliding over it.

The arms 14 are provided, at their ends facing the calliper 6, with means for retaining the ring 19 in its up position (FIGS. 2 and 3). In the embodiment described, these retaining means comprise a collar 23 formed at the ends of the arms 14 and projecting preferably at right angles to their surface, and an annular bead 24 formed around the arms 14 at a distance d which is substantially equal to the thickness of the ring 19. The bead 24 is rounded to form a convex swelling, in order to allow the ring 19 to slip over it in the direction of the collar 23.

The sequence in which the ring 19 is positioned on the sleeve 13 is as follows.

1. The position of the rod 11 in the sleeve 13 is first adjusted as described in the main patent 2. (FIG. 1) The mechanism 3 is in the raised position, after the handle 4 has been swung about the axis 8 in such a way that the end engaged in the calliper 6 draws the calliper upwards, along with the rod 11 and sleeve 13 through the fixed plate 21. Resting on this plate is the ring 19 through which the sleeve 13 also passes. This ring is pierced for this purpose with a central orifice 19*a* whose diameter is equal to that of the sleeve 13 and substantially less than that of the orifice 22.

3. The handle 4 is swung in the direction which opens the door for the first time, and this drives the calliper 6, the rod 11 and the sleeve 13 downwards (FIG. 2). The sleeve 13 therefore slides through the ring 19 which is held by the fixed plate 21, in such a way that this ring slips over the surface of the arms 14, over the bead 24 which it straddles and then passes, and finally stops up against the collar 23. At this stage the ring 19 is locked between the collar 23 and the plate 21, and the bead 24 is down inside the hole 22.

4. (FIG. 3) The handle 4 swings once again in the direction which causes the elements of the mechanism 3 to be lifted up again (closing of the door). In the course of this movement, the sleeve 13 slides through the orifice 22 of the plate 21 and the ring 19 is held in place around the ends of the arms 14 by the non-return bead 24 and the stop collar 23. The central hole 19*a* is dimensioned so that the ring 19 firmly clamps the arms 14 onto the rack 12, and thus resists any relaxing or coming transversely away of the ends of the flexible arms 14, such as could cause their inner teeth to disengage from the rack 12.

In this way total irreversibility of the mechanism 3 in both directions of the link between the rod 11 and sleeve 13 is guaranteed. This is because the ring 19 prevents any slippage of the teeth of the arms 14 over the rack 12.

This arrangement is particularly advantageous when the lever of the lock becomes jammed, by ice or for any other reason.

In the alternative embodiment of FIG. 4, the bead 24 is replaced by elastic tabs 25, which are integral with the arms 14 and are situated at a distance d from the collar 23 which is substantially equal to the thickness of the ring 19. The tabs 25 are each of substantially triangular cross-section, namely: from the side nearest the pin 2 a gently sloping, preferably curved part 25*a* integral at its base with the arms 14, and from the side nearest the collar 23 a steeply sloping part 25*b*. Thus the ring 19 slips over the sides 25*a* and 25*b*, squeezing them in successively, after which the abrupt sides 25*b* spring back and resist any return of the ring 19, making its emplacement irreversible.

I claim:

1. Mechanism (3) for linking an opening handle (4) to a push pin (2) for the lock (1) of a vehicle door, comprising a calliper (6) designed to receive the handle (4), a rod (11) which connects this calliper with the pin, engaged so as to slide in only one direction in a sleeve (13) by virtue of a non-return system, in such a way that after the handle and calliper have been assembled, a swinging down of the handle causes a relative movement of the rod (11) and of the sleeve (13), setting their respective positions without play, the rod (11) being provided for this purpose with a rack (12) which penetrates axially into the sleeve (13) between flexible longitudinal clamping arms (14), which are able to interact with the rack (12) to set the axial position of the rod in the sleeve, characterized in that the sleeve (13) is equipped with a ring (19) which is slidably fitted around the sleeve and can be moved during set-up from a first position at the base of the flexible arms (14) to a second position situated at the ends of the said arms nearest the calliper (6), in which position the ring (19) clamps the arms (14) around the rack (12), and these arms are provided at their said ends with means for retaining the ring in the said second position.

2. Mechanism according to claim 1, characterized in that the means for retaining the ring (19) comprise a collar (23) formed at the ends of the arms (14) and an annular bead (24) formed around the arms at a distance (d) which is substantially equal to the thickness of the ring, which can thus be locked, axially, between the bead (24) and the collar (23) after the respective positions of the rod (11) and of the sleeve (13) have been set without play.

3. Mechanism according to claim 2, characterized in that the terminal collar (23) of the arms (14) forms an axial arresting stop for the ring (19), whereas the bead (24) is rounded to allow the ring (19) to slip over it towards the collar (23), whilst subsequently resisting any slipping of the ring in the opposite direction.

4. Mechanism according to claim 1, characterized in that the means for retaining the ring (19) comprise an annular collar (23) formed at the ends of the arms (14), and elastic tabs (25) fixed to the arms at a distance (d) from the collar (23) which is substantially equal to the thickness of the ring (19), these tabs being shaped to allow the ring (19) to slip over them and then elastically to resist its returning in the opposite direction.

* * * * *